US006877497B2

(12) United States Patent
Skinner et al.

(10) Patent No.: US 6,877,497 B2
(45) Date of Patent: Apr. 12, 2005

(54) IGNITION COIL CASSETTE HAVING EPOXY ANCHORED BUSHINGS

(75) Inventors: Albert Anthony Skinner, Anderson, IN (US); Kenneth P. Senseman, Noblesville, IN (US); Colin Hamer, Carmel, IN (US); Raymond O. Butler, Jr., Anderson, IN (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/371,293

(22) Filed: Feb. 21, 2003

(65) Prior Publication Data

US 2004/0163632 A1 Aug. 26, 2004

(51) Int. Cl.[7] ..... F02P 15/00

(52) U.S. Cl. ..... 123/634; 123/635; 123/647; 335/219; 29/464

(58) Field of Search ..... 123/634, 169 CA, 123/143 C, 169 P, 635, 647; 29/464; 335/219

(56) References Cited

U.S. PATENT DOCUMENTS 5,003,958 A * 4/1991 Yoneyama et al. ..... 123/635
5,109,828 A * 5/1992 Tagami et al. ..... 123/635
5,890,473 A * 4/1999 Hammer et al. ..... 123/635
6,169,471 B1 * 1/2001 Sakamaki et al. ..... 336/96
6,543,430 B2 * 4/2003 Moga et al. ..... 123/634
6,622,711 B1 * 9/2003 Skinner et al. ..... 123/634
6,655,368 B2 * 12/2003 Wada ..... 123/635
6,675,786 B2 * 1/2004 Tsunenaga et al. ..... 123/635
6,776,147 B2 * 8/2004 Tsunenaga et al. ..... 123/635
6,805,086 B2 * 10/2004 Kawai ..... 123/169 PA

* cited by examiner

*Primary Examiner*—Hai Huynh
(74) *Attorney, Agent, or Firm*—Jimmy L. Funke

(57) ABSTRACT

An ignition coil cassette having bushings retained by an irregularity of the bushings being encased by epoxy. As a result, the process by which the bushings are installed into the ignition coil cassette avoids the cost associated with the overmolding installation process, and further avoids the potential for damage associated with the ultrasonic insertion process. The irregularity is located generally adjacent one end of each of the bushings and may be, for example, in the form of an undercut or a protrusion.

10 Claims, 3 Drawing Sheets

IGNITION COIL CASSETTE HAVING EPOXY ANCHORED BUSHINGS

TECHNICAL FIELD

The present invention relates to automotive engine ignition coil cassettes, and more particularly to a bushing installation methodology therefor.

BACKGROUND OF THE INVENTION

Ignition coil cassettes used for automotive applications are constructed of plastic with epoxy potting, and include metallic bushings through which mounting bolts pass for mounting the ignition coil cassette to a mounting surface.

As shown at FIGS. 1 through 3, the current practice is to provide an automotive engine ignition coil cassette 10 with metallic bushings 12 therefor. The bushings 12 have an irregularity 14, such as a knurl, a hole, or an undercut 14' for being anchored relative to the casing by interfacing with plastic. The bushings 12 are, according to one methodology of the prior art, overmolded with plastic 16 seatably into a cylindrical bushing seat 18 which is coextensive with the bushing. Alternatively according to a second methodology of the prior art, the bushings 12 are ulrasonically inserted by pressing into position at the respective bushing seats 18.

Plastic overmolding of the bushing represents an expensive extra production step. On the other hand, ultrasonic insertion, while eliminating the plastic overmolding step, can potentially cause damage to the ignition coil cassette.

Accordingly, what is needed is a process by which bushings may be installed into an ignition coil cassette without the cost associated with the plastic overmolding installation process, and without the potential for damage associated with the ultrasonic insertion process.

SUMMARY OF THE INVENTION

The present invention is an ignition coil cassette having bushings retained by an irregularity of the bushings being encased by epoxy potting, rather than by the plastic interfacing methodologies utilized in the prior art. As a result, the process by which the bushings are installed into the ignition coil cassette avoids the cost associated with the overmolding installation process, and further avoids the potential for damage associated with the ultrasonic insertion process.

The bushing according to the present invention is metallic, having a hollow cylindrical configuration, wherein adjacent one end thereof is an irregularity. The irregularity may be, for example, an undercut, a knurl, or a protrusion. The ignition coil cassette has a plastic casing having a plurality of bushing seats formed therein, one bushing seat, respectively, for each bushing. Each bushing seat is a cylindrical passage through the casing defined by a cylindrical wall, the length of which being less than the length of the bushing such that when the bushing is pressed thereinto, the irregularity is exposed, free of the cylindrical wall.

Operatively, each bushing is pressed into its respective bushing seat in the plastic casing of the ignition coil cassette such that the irregularity thereof does not enter into the bushing seat. Advantageously, a protuberant irregularity may serve as a bushing locating stop when the irregularity abuts the upper surface of the cylindrical wall. Thereafter, epoxy is potted into the void above the bushing seat, surrounding and anchoring the exposed portion of the bushing, including the irregularity thereof, so as to thereby anchor the bushing with respect to the casing.

Accordingly, it is an object of the present invention to provide an ignition coil cassette having bushings which are anchored by an irregularity thereof engaging epoxy potting.

It is an additional object of the present invention to provide a method for installing bushings into an ignition coil cassette, wherein the bushings are anchored by epoxy potting.

These and additional objects, features and advantages of the present invention will become clearer from the following specification of a preferred embodiment.

DESCRIPTION OF THE PREFERRED EMBODIMENT

Figure 1A:
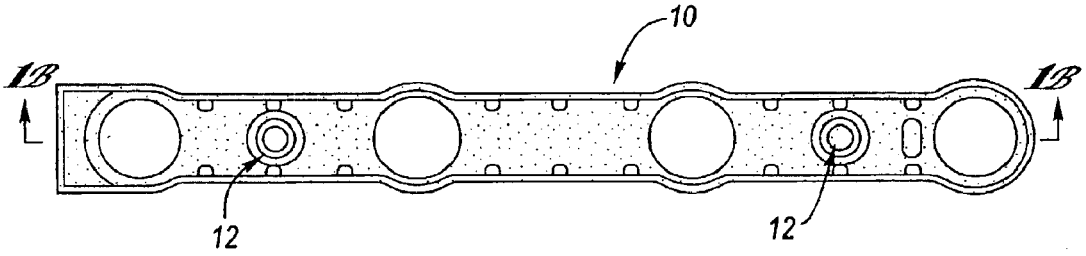
Prior Art Fig. 1A
FIG. 1A is a plan view of a prior art ignition coil cassette having bushings therefor installed.
Figure 1B:
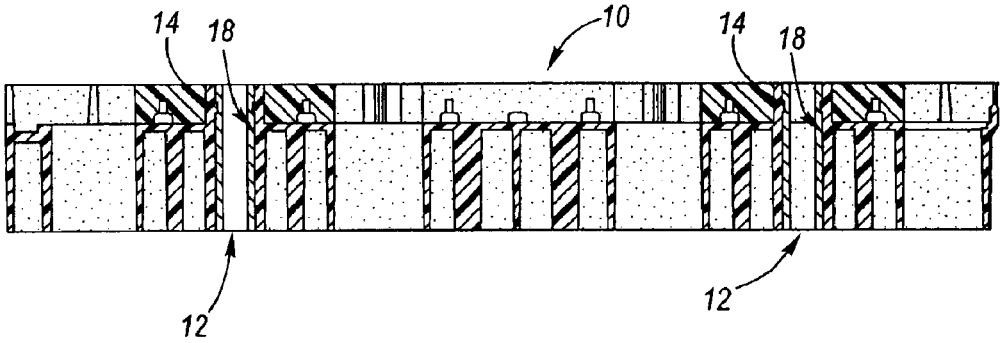
Prior Art Fig. 1B
FIG. 1B is a partly sectional view of the prior art ignition coil cassette, seen along line 1B—1B of FIG. 1A.

Referring now to the Drawing, FIGS. 3 through 6 depict an installation methodology for providing an ignition coil cassette 100 with bushings 102 according to the present invention.

Firstly, the ignition coil cassette 100 is fabricated, including a plastic casing 104. The plastic casing 104 includes a plurality of bushing seats 106, each composed of a cylindrical wall 106W passing entirely through the casing. The cylindrical wall 106W is truncated at its upper end 106U, having a bushing seat length L.

A metallic bushing 102 is provided for each bushing seat, respectively. Each bushing 102 is in the form of a hollow cylinder, having an irregularity 108 formed generally adjacent a first end 102F thereof. The length L' of the bushing is longer than that of the bushing seat length L, such that when the bushing is pressed into its respective bushing seat 106, the irregularity is exposed, free of the cylindrical wall 106W. The irregularity 108 shown is that of an annular undercut 108', but may be otherwise configured, as will be discussed hereinbelow.

Figure 2A:
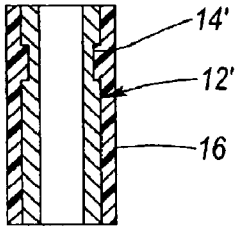
Prior Art Fig. 2A
FIG. 2A is a sectional view of a prior art plastic overmolded bushing.
Figure 2B:
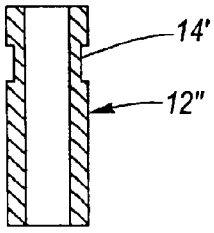
Prior Art Fig. 2B
FIG. 2B is a sectional view of a prior art bushing.
Figure 3:
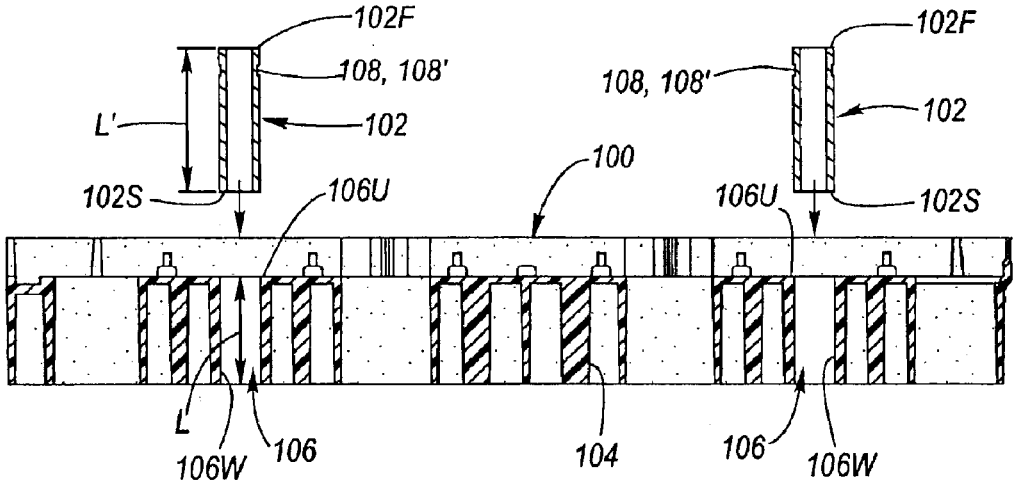
FIG. 3 is a partly side view of an ignition coil cassette according to the present invention, wherein bushings therefor are at an initial stage of installation.
Figure 4:
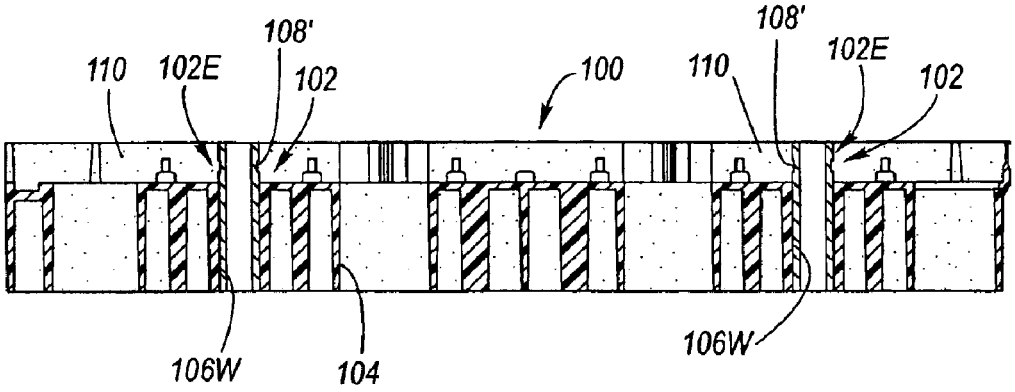
FIG. 4 is a partly sectional side view, as in FIG. 3, wherein now the bushings have been pressed into their respective bushing seats.
Figure 5:
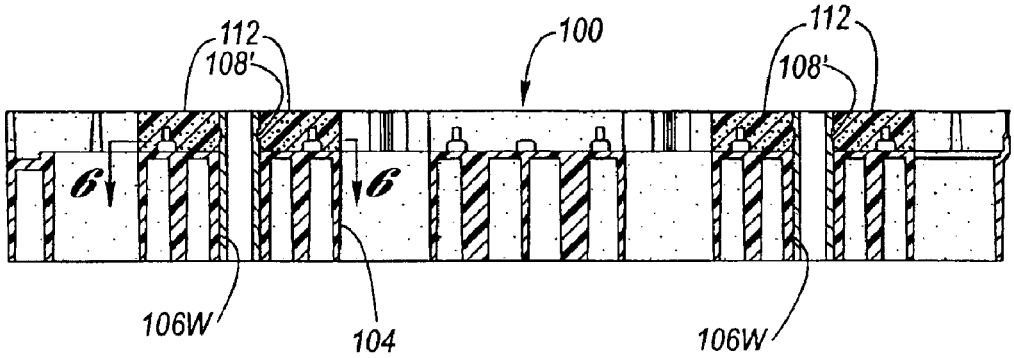
FIG. 5 is a partly sectional side view as in FIG. 4, wherein now the bushings have been anchored by epoxy potting according to the present invention.
Figure 6:
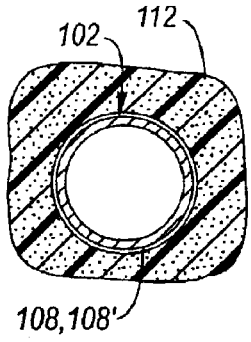
FIG. 6 is a detail, perspective view of a bushing having a first form of irregularity seated in its respective bushing seat and anchored by epoxy potting according to the present invention.

In operation, as shown by FIGS. 3 through 6, each bushing 102 is pressed into its respective bushing seat 106, wherein a second end 102S of each bushing 102 enters firstly into its respective bushing seat. Once seated, as shown at FIG. 2, each bushing 102 has an exposed portion 102E above the upper end 106U of the cylindrical wall 106W, wherein the exposed portion includes the irregularity 108. As shown at FIG. 5, an epoxy 112 is placed into a cup-shaped void 110 surrounding the exposed portion 102E of each of the bushings 102, respectively. The epoxy 112 is a potting which, when in a liquid state, fluidly conforms with respect to the irregularity 108 such that when it solidifies, it provides a hardened interfering interface with respect to the irregularity 108. As a result, the bushings 102 are anchored to the epoxy. Since the epoxy 112 is, itself, attached to the casing 104 at the cup shaped well 110, the bushing 102 is thereby attached to the casing.

Figure 7A:
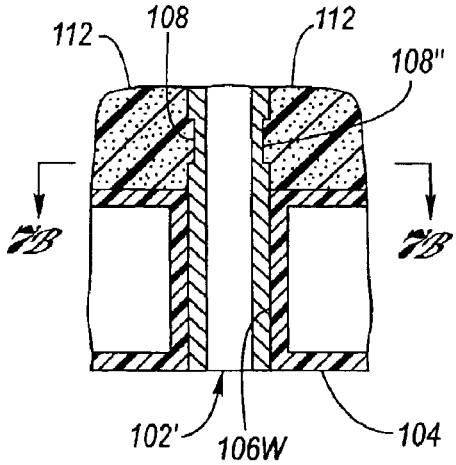
FIG. 7A is a detail, perspective view of a bushing having a second form of irregularity seated in its respective bushing seat and anchored by epoxy potting according to the present invention.
Figure 7B:
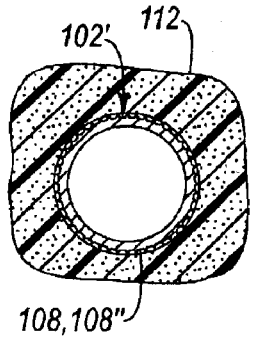
FIG. 7B is a partly sectional view, seen long line 7B—7B of FIG. 7A.
Figure 8A:
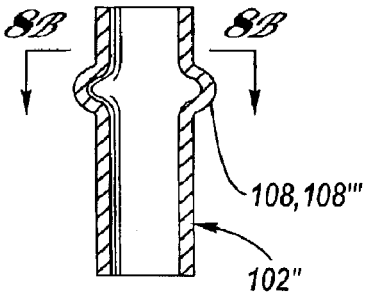
FIG. 8A is a sectional view of a bushing having a third form of irregularity according to the present invention.
Figure 8B:
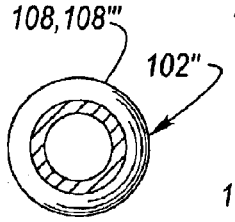
FIG. 8B is a partly sectional view, seen along line 8B—8B of FIG. 8A.
Figure 9A:
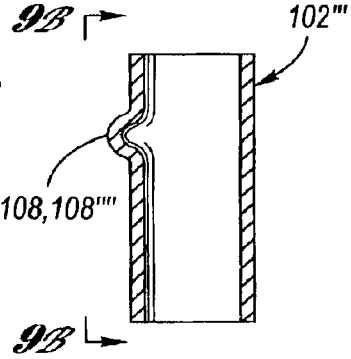
FIG. 9A is a sectional view of a bushing having a fourth form of irregularity according to the present invention.
Figure 9B:
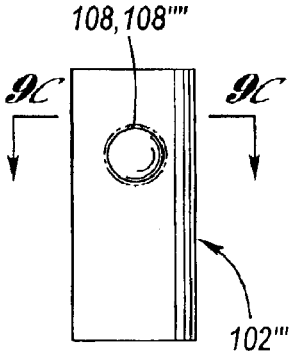
FIG. 9B is a side view, seen along line 9B—9B of FIG. 9A.
Figure 9C:
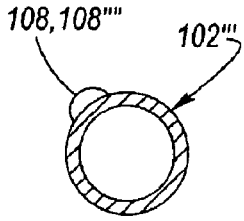
FIG. 9C is a partly sectional view, seen along line 9C—9C of FIG. 9B.

As mentioned hereinabove, the irregularity 108 of the bushings 102 may have configurations other than an annular undercut 108' as shown at FIGS. 3 through 6. For example, FIGS. 7A and 7B depict a bushing 102' having an irregularity 108 in the form of an annular knurl 108". Further for example, FIGS. 8A and 8B depict a bushing 102" having an irregularity 108 in the form of an annular protuberance 108'". For yet another example, FIGS. 9A through 9C depict a bushing 102'" having an irregularity 108 in the form of a knobular protuberance 108"". It is to be understood that the irregularity 108 may assume any suitable configuration which ensures an interfering interface with respect to the epoxy 112 which thereby anchors the bushing to the casing in the manner hereinabove discussed.

Figure 10:
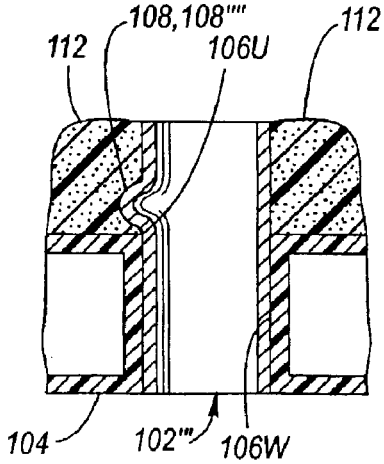
FIG. 10 is a detail, perspective view of a bushing having the fourth form of irregularity seated in its respective bushing seat and anchored by epoxy potting according to the present invention.

An advantage of a protuberant irregularity 108'", 108"" is that the protuberance may serve to provide definite location of the bushing 102", 102'" with respect to the cylindrical wall 106W of the bushing seat 106. In this regard, as the bushing 102", 102'" is pressed downwardly into its respective bushing seat 106, the protruding aspect of the protuberant irregularity 108'", 108"" positively abuts the upper end 106U of the cylindrical wall 106W precisely when the bushing is correctly seated with respect to the bushing seat 106, as representatively shown at FIG. 10 (which depicts, by way of example, the irregularity 108'"). Of course, if the annular knurling would be protuberant, then it could suffice as a location stop, as well.

To those skilled in the art to which this invention appertains, the above described preferred embodiment may be subject to change or modification. Such change or modification can be carried out without departing from the scope of the invention, which is intended to be limited only by the scope of the appended claims.

What is claimed is:

1. An ignition coil cassette, comprising:

a casing having a bushing seat;

a bushing snuggly received into said bushing seat, wherein said bushing has an irregularity substantially adjacent one end thereof, said irregularity being exposed with respect to said bushing seat, said bushing having a bushing length; and an epoxy potted into a selected portion of said casing, said epoxy interfacing with said irregularity so as to anchor said bushing with respect to said casing.

2. The ignition coil cassette of claim 1, wherein said irregularity comprises at least one of an annular undercut, an annular knurl, an annular protuberance, and a knobular protuberance.

3. The ignition coil cassette of claim 1, wherein said bushing seat comprises a cylindrical wall formed in said casing, wherein said cylindrical wall has a bushing seat length; and wherein said bushing seat length is less than said bushing length so as to provide said exposure of said irregularity when said bushing is seated in said bushing seat.

4. The ignition coil cassette of claim 3, wherein said irregularity comprises at least one of an annular undercut, an annular knurl, an annular protuberance, and a knobular protuberance.

5. The ignition coil cassette of claim 4, further comprising a plurality of said bushing seats formed in said casing, and a plurality of said bushings, a bushing being respectively seated in each bushing seat.

6. The ignition coil cassette of claim 3, wherein said irregularity comprises a protuberance.

7. The ignition coil cassette of claim 6, wherein said protuberance abuts said cylindrical wall when said bushing is seated in said bushing seat.

8. The ignition coil cassette of claim 7, further comprising a plurality of said bushing seats formed in said casing, and a plurality of said bushings, a bushing being respectively seated in each bushing seat.

9. A method for providing an ignition coil cassette, comprising the steps of:

forming a plastic casing having at least one bushing seat formed therein;

forming at least one bushing having an irregularity adjacent one end thereof;

pressing said a said bushing into a respective said bushing seat, wherein said irregularity is exposed with respect to said bushing seat;

placing a liquid state epoxy into a selected portion of said casing, wherein the epoxy interfaces with said irregularity; and solidifying the epoxy to thereby adhere the epoxy to the casing and interferingly interface the epoxy with respect to the irregularity, whereupon the bushing is anchored by the epoxy to the casing.

10. The method of claim 9, wherein said step of forming at least one bushing comprises forming a protuberant irregularity, wherein said step of pressing comprises locating said bushing with respect to said bushing seat by abutting said protuberant irregularity with respect to said casing at said bushing seat.

* * * * *